US007415848B2

(12) United States Patent
Jeong et al.

(10) Patent No.: US 7,415,848 B2
(45) Date of Patent: Aug. 26, 2008

(54) PULSATOR TYPE WASHING MACHINE WITH DRYING FUNCTION

(75) Inventors: In Chul Jeong, Koyang-shi (KR); Mu Yong Choi, Seoul (KR); Kyeong Hwan Kim, Puchon-shi (KR); Bo Young Chang, Seoul (KR)

(73) Assignee: LG Electronics Inc., Seoul (KR)

( * ) Notice: Subject to any disclaimer, the term of this patent is extended or adjusted under 35 U.S.C. 154(b) by 952 days.

(21) Appl. No.: 10/052,553

(22) Filed: Jan. 23, 2002

(65) Prior Publication Data

US 2002/0100298 A1 Aug. 1, 2002

(30) Foreign Application Priority Data

Feb. 1, 2001 (KR) ..... P2001-4871
Feb. 2, 2001 (KR) ..... P2001-5122

(51) Int. Cl.
*D06F 25/00* (2006.01)

(52) U.S. Cl. ..... 68/18 C; 68/19.1; 68/20

(58) Field of Classification Search ..... 68/12.07, 68/13 R, 19.1, 19.2, 20, 23, 23.3; 34/72, 34/73, 74, 75, 76, 78, 79, 80, 81, 82, 83, 34/84; 261/108, 109, 110, 111, 112.1, 115, 261/DIG. 10, DIG. 32
See application file for complete search history.

(56) References Cited

U.S. PATENT DOCUMENTS 486,144 A * 11/1892 Webber ..... 55/457
793,110 A * 6/1905 Uehling ..... 261/79.2
1,783,813 A * 12/1930 Schneible ..... 96/315
1,793,244 A * 2/1931 Phelps ..... 165/131
1,865,775 A * 7/1932 Martocello, Sr. ..... 138/38
1,920,313 A * 8/1933 Mautsch ..... 165/151
2,192,124 A * 2/1940 Brill et al. ..... 560/232
2,311,155 A * 2/1943 Carr ..... 261/30
2,389,005 A * 11/1945 Sebald ..... 261/115
2,408,290 A * 9/1946 Byer ..... 261/108
2,409,088 A * 10/1946 Weits et al. ..... 96/319
2,451,692 A * 10/1948 Pugh ..... 34/74
2,526,344 A * 10/1950 Geldhof et al. ..... 68/148
2,539,344 A * 1/1951 Carraway ..... 261/3

(Continued)

FOREIGN PATENT DOCUMENTS

DE 24 29 078 * 1/1976

(Continued)

OTHER PUBLICATIONS

WO 93/17169 (Melroni) Aug. 1993.*

(Continued)

*Primary Examiner*—Frankie L Stinson
(74) *Attorney, Agent, or Firm*—Birch, Stewart, Kolasch & Birch, LLP

(57) ABSTRACT

A pulsator type washing machine having a washing function and a drying function in one unit, includes a first tub, a second tub disposed in the first tub, and a structure operatively coupled with at least one of the first and second tubs to receive air from the second tub, dehumidify the air and recirculate the dehumidified air back into the second tub to dry laundry in the second tub during a drying operation of the washing machine.

3 Claims, 5 Drawing Sheets

U.S. PATENT DOCUMENTS 2,590,295 A * 3/1952 Constantine ..... 34/75
2,607,209 A * 8/1952 Constantine
2,608,769 A * 9/1952 O'Neal ..... 34/131
2,627,669 A * 2/1953 Candor ..... 34/547
2,722,057 A * 11/1955 Pugh ..... 34/74
2,724,906 A * 11/1955 Pfleider ..... 34/75
2,742,708 A * 4/1956 McCormick ..... 34/76
2,782,622 A * 2/1957 Candor
2,792,640 A * 5/1957 Patterson ..... 34/75
2,813,414 A * 11/1957 Johnston
2,817,415 A * 12/1957 Sykes ..... 95/219
2,818,719 A * 1/1958 Cline
2,824,385 A * 2/1958 Toma ..... 34/75
2,842,943 A * 7/1958 Geldhof et al.
2,863,311 A * 12/1958 Brucken ..... 68/12.01
2,864,175 A * 12/1958 Stone ..... 34/75
2,873,537 A * 2/1959 Gray, Jr. et al. ..... 34/75
2,878,662 A * 3/1959 Brucken ..... 68/19.2
2,881,609 A * 4/1959 Brucken
2,881,633 A * 4/1959 Warhus ..... 477/19
2,940,179 A * 6/1960 Czech ..... 34/77
2,961,865 A * 11/1960 Frey ..... 68/207
3,001,297 A * 9/1961 Plumer ..... 34/607
3,006,176 A * 10/1961 Behrens
3,012,333 A * 12/1961 Leonard ..... 34/75
3,029,525 A * 4/1962 Pinder ..... 34/75
3,068,877 A * 12/1962 Jacobs ..... 134/99.1
3,091,955 A * 6/1963 Taylor et al.
3,116,984 A * 1/1964 Decatur
3,121,000 A * 2/1964 Hubbard
3,216,126 A * 11/1965 Brucken et al. ..... 34/537
3,217,799 A * 11/1965 Rodgers ..... 165/179
3,248,801 A * 5/1966 Morton et al. ..... 34/572
3,314,255 A * 4/1967 Neumann et al.
3,368,614 A * 2/1968 Anderson ..... 165/82
3,402,576 A * 9/1968 Krupsky ..... 68/4
3,618,344 A * 11/1971 Hoffman ..... 68/23.5
3,631,923 A * 1/1972 Izeki ..... 165/167
3,837,396 A * 9/1974 Newton
3,866,333 A * 2/1975 Sarukahanian et al. ..... 34/75
3,990,870 A * 11/1976 Miczek ..... 95/217
4,059,419 A * 11/1977 Ross ..... 95/214
4,103,433 A * 8/1978 Taylor ..... 34/86
4,154,003 A * 5/1979 Muller ..... 34/469
4,154,296 A * 5/1979 Fijas ..... 165/179
4,204,339 A * 5/1980 Muller
4,256,674 A * 3/1981 Shafranovsky et al. ... 261/112.1
4,275,510 A * 6/1981 George ..... 34/90
4,382,045 A * 5/1983 Wem ..... 261/89
4,545,428 A * 10/1985 Onishi et al.
4,658,892 A 4/1987 Shinohara et al.
4,866,830 A * 9/1989 Zohler
5,074,131 A * 12/1991 Hirose et al.
5,085,826 A * 2/1992 Oosterkamp ..... 376/371
5,111,673 A * 5/1992 Kadoya et al. ..... 68/12.04
5,146,693 A 9/1992 Dottor et al.
5,207,764 A * 5/1993 Akabane et al. ..... 68/20
5,253,567 A * 10/1993 Gunawardena ..... 99/404
5,277,210 A * 1/1994 Kim ..... 134/95.2
5,293,761 A * 3/1994 Jang ..... 68/15
5,327,603 A * 7/1994 Roh et al. ..... 8/159
5,588,313 A * 12/1996 Hildebrand
5,590,552 A * 1/1997 Kim ..... 68/207
5,632,962 A * 5/1997 Baker et al. ..... 422/211
5,768,730 A * 6/1998 Matsumoto et al. ..... 8/159
5,983,520 A * 11/1999 Kim et al. ..... 34/261
6,282,928 B1 * 9/2001 Fukumoto et al.
6,378,342 B1 * 4/2002 Fukumoto et al.
6,418,248 B1 * 11/2002 Willis
6,578,627 B1 * 6/2003 Liu et al. ..... 165/109.1
6,840,307 B2 * 1/2005 Eesley et al. ..... 165/80.3

FOREIGN PATENT DOCUMENTS

DE 24 51 339 * 4/1976
DE 29 04 419 8/1980
DE 30 27 900 * 2/1982
DE 39 29 003 A1 3/1991
EP 0 704 569 A1 4/1996
EP 0 942 093 A1 9/1999
FR 1 348 053 1/1964
GB 2044297 * 10/1980
GB 2 075 559 * 11/1981
GB 2075559 * 11/1981
GB 2215826 * 9/1989
JP 54-125563 * 9/1979
JP 57-58092 * 4/1982
JP 58-183293 * 10/1984
JP 2-46895 * 2/1990
JP 2-241486 * 9/1990
JP 4-352999 * 12/1992
JP 9-173697 * 7/1997
JP 10-071292 A 3/1998
JP 11-128594 * 5/1999
JP 11-164981 * 6/1999
JP 11-34296 * 12/1999
JP 2000-282857 * 10/2000
WO WO 93/17169 9/1993
WO WO 94/10370 5/1994

OTHER PUBLICATIONS

WIPO WO 93/17169 Sep. 1993.*
WIPO WO 94/10370 May 1994.*
European Patent Office 0 743 389 Nov. 1996.*
European Patent Office 0 485 700 Aug. 1991.*
European Patent Office 0 704 569 Apr. 1996.*

* cited by examiner

PULSATOR TYPE WASHING MACHINE WITH DRYING FUNCTION

RELATED APPLICATION

The present application claims the benefit of Korean Patent Application No. P2001-4871 filed Feb. 1, 2001 and Korean Patent Application No. P2001-5122 filed Feb. 2, 2001, each of which is herein fully incorporated by reference.

BACKGROUND OF THE INVENTION

1. Field of the Invention

The present invention relates to a washing machine and, more particularly, to a pulsator type washing machine having a washing function and a drying function in one unit.

2. Discussion of the Related Art

Washing machines remove contaminants from the laundry by applying different forms of impact force to the laundry. Generally, washing machines can be categorized into pulsator type washing machines, drum type washing machines, and agitator type washing machines according to the type of impact force applied to the laundry. In these cases, an impact force is generated and applied to the laundry by means of a pulsator or an agitator, or by dropping the laundry using a rotating drum. A detergent is typically added to the washing machines to enhance the washing process.

In general, these conventional washing machines provide only the washing function to wash the laundry such as clothes. Therefore, a washing machine user is required to take out the laundry from the washing machine after completion of the washing process to dry the wet laundry.

Apartment living arrangements and other living styles often demand an artificial drying of the laundry within a short time period after the laundry is washed. To this cause, dryers have been developed. A conventional dryer permits the user to dry the wet laundry more quickly and easily. However, the size of a conventional dryer is typically equal to or larger than the size of a conventional washing machine. Thus, installation of both the washing machine and the dryer requires much installation space. Further, the washed laundry from the washing machine must be manually moved to the dryer before it can be dried, which can be extremely inconvenient and tedious to the user.

Accordingly, a washing machine having the drying function has been in need, and a drum type washing machine that can also dry the wet laundry in the drum has been proposed. However, conventional pulsator type or agitator type washing machines, which have a better washing performance than the drum type washing machines, do not provide the drying function. As a result, a need exists for a pulsator type washing machine that facilitates drying of laundry and provides excellent washing of the laundry.

SUMMARY OF THE INVENTION

Accordingly, the present invention is directed to a pulsator type washing machine that substantially obviates one or more of the problems due to limitations and disadvantages of the related art.

An object of the present invention is to provide a pulsator type washing machine which has an excellent washing performance and facilitates drying of laundry.

Another object of the present invention is to provide a pulsator type washing machine having both washing and drying functions in one unit.

Additional features and advantages of the invention will be set forth in the description which follows, and in part will be apparent from the description, or may be learned by practice of the invention. The objectives and other advantages of the invention will be realized and attained by the structures particularly pointed out in the written description and claims hereof as well as the appended drawings.

To achieve these and other advantages and in accordance with the purpose of the present invention, as embodied and broadly described, a pulsator type washing machine includes a circulation duct having one end connected to a lower part of an outer tub and the other end positioned in the vicinity of an upper part of an inner tub, a fan fitted on the circulation duct for forced circulation of air, a heater fitted to the circulation duct for heating the air flowing in the circulation duct, and a water supplying duct connected between the circulation duct and a water feed valve for supplying external water to the circulation duct.

The fan is preferably a sirocco fan, the circulation duct preferably has a plurality of grooves in an inside wall surface thereof, and more preferably the groove is helical.

The pulsator type washing machine may further include an external air supplying duct connected to the washing machine case for supplying external air to the circulation duct direction, and an external air fan fitted to an inlet to the external air supplying duct for drawing the external air.

The external air supplying duct may have an outlet extended to an inside of the circulation duct, and the circulation duct preferably has a plurality of cooling fins fitted to an outside surface thereof.

The pulsator type washing machine may further include a water supplying supplementary duct fitted between the feed water valve and the outer tub cover for supplying external water to an inside wall of the outer tub. The outer tub cover has a flow passage having a plurality of water spraying holes on a bottom thereof.

In another aspect of the present invention, there is provided a pulsator type washing machine including a circulation duct having one end connected to a lower part of an outer tub and the other end positioned in the vicinity of an upper part of an inner tub, a fan fitted on the circulation duct for forced circulation of air, a heater fitted to the circulation duct for heating the air flowing in the circulation duct, an external air supplying duct connected to the washing machine case for supplying external air to a circulation duct direction, and an external air fan fitted to an inlet to the external air supplying duct for drawing external air.

The external air fan is preferably an axial fan, and the circulation duct preferably has a plurality of cooling fins fitted to an outside surface thereof.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings. At first, the overall system of a pulsator type washing machine 100 in accordance with a first preferred embodiment of the present invention will be explained with reference to FIG. 1. The components used to wash the laundry will be explained first.

Figure 1:
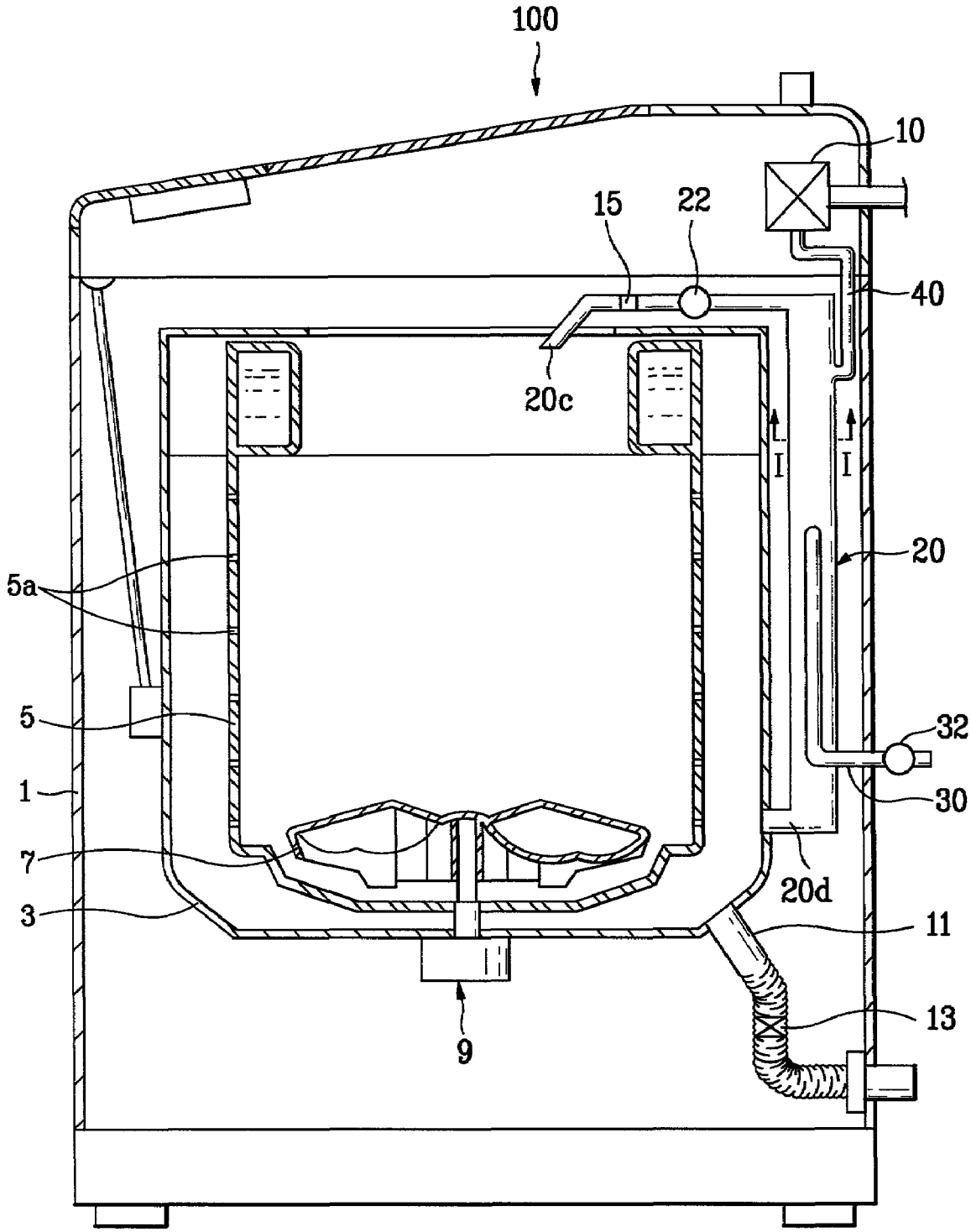
FIG. 1 illustrates a sectional view of a pulsator type washing machine in accordance with a first preferred embodiment of the present invention.

As shown in FIG. 1, the pulsator type washing machine 100 includes an outer tub 3 disposed in a washing machine case 1, an inner tub 5 having a plurality of openings 5*a* and rotatably mounted in the outer tub 3, and a pulsator 7 rotatably mounted in the inner tub 5. The inner tub 5 and the pulsator 7 are rotatably, as known, by the operation of driving means 9 provided at a bottom of the outer tub 3.

The washing machine 100 further includes a feed water valve 10 disposed in an upper part of the case 1 for supplying water needed for washing and rinsing the laundry, and a drain duct 11 connected to a bottom portion of the outer tub 3 for draining out the waste water from the washing machine 100 after completion of the washing operation. A drain valve 13 is disposed at a certain portion of the drain duct 11. A water supply duct 40 is connected to the feed water valve 10 for supplying water to the inner tub 5. All these components are operatively coupled.

Next, components of the washing machine 100 used to dry the laundry will be explained according to an embodiment of the present invention.

The pulsator type washing machine 100 also includes a circulation duct 20 disposed between the outer tub 3 and the case 1 for supplying heated air to the inner tub 5 for drying the laundry. A lower end portion of the circulation duct 20 is connected the outer tub 3, and an upper end portion of the circulation duct 20 is positioned in the vicinity of a top part of the inner tub 5. A heater 15 is disposed at one end portion of the circulating duct 20 for heating the air, and a fan 22 for improving the circulation of the air is disposed at the circulation duct 20 adjacent the heater 15. The fan 22 is preferably of a centrifugal type, and more preferably of a sirocco fan type. The heater 15 is preferably fitted to a place forward of the fan 22 (an air outlet direction of the circulation duct 20). Air in the inner tub 5 that is discharged through the openings 5*a* enters the circulation duct 20 through an inlet/outlet 20*d* of the circulation duct 20. This air then moves upwardly in the circulation duct 20 by the operation of the fan 22 and is heated by the heater 15. Then the heated air is output into the inner tub 5 through an air outlet 20*c* of the circulation duct 20 to dry the washed laundry in the inner tub 5. This process can be repeated to provide heated air continuously to the inside of the inner tub 5.

The water supplying duct 40 is connected between a top portion of the circulation duct 20 and the feed water valve 10. The water supplying duct 40 is used as follows. Air discharged from the air outlet 20*c* of the circulation duct 20 to dry the laundry in the inner tub 5 is discharged through the openings 5*a* and enters the inlet/outlet 20*d* of the circulation duct 20. This air tends to be hot and humid and is recirculated back to the inner tub 5 through the air outlet 20*c*. But, since the recirculation of this hot and humid air back to the inner tub 5 through the air outlet 20*c* provides a poor drying efficiency, the moisture in the hot and humid air needs to be removed before this air re-enters the inner tub 5. To accomplish this task, external water is supplied to an upper part of an inner wall of the circulation duct 20 via the feed water valve 10 and the water supplying duct 40. Then, this water makes heat exchange with the hot and humid air being recirculated through the circulation duct 20 as the water flows down along the inner walls of the circulation duct 20. This process condenses the water vapors in the hot and humid air. The condensed water is drained out of the washing machine 100 through the inlet/outlet 20*d*, a bottom of the outer tub 3 and the drain duct 11 under control of the drain valve 13.

Accordingly, the washing machine 100 of the present invention dries effectively the washed laundry in the inner tub 5.

Figure 2:
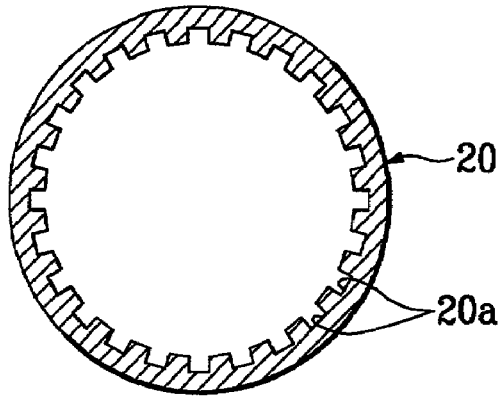
FIG. 2 illustrates a cross-sectional view of a circulation duct, cut alone line I-I in FIG. 1.
Figure 3:
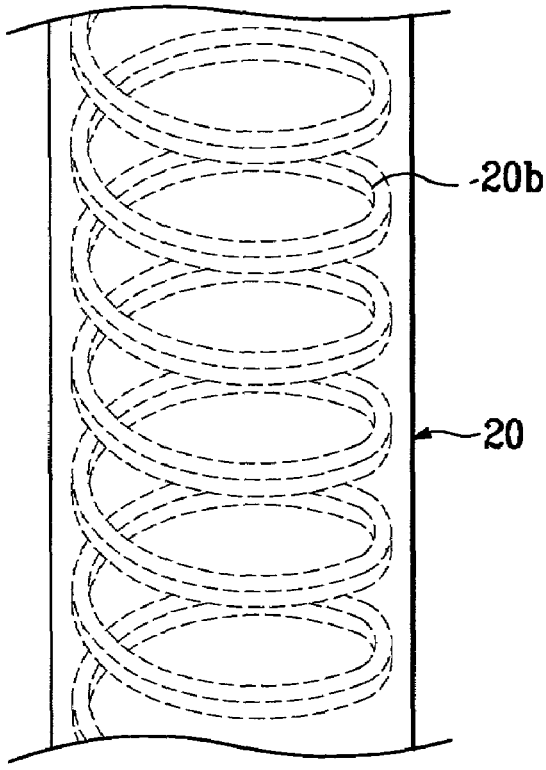
FIG. 3 illustrates a perspective view of a circulation duct usable in the washing machine of FIG. 1 in accordance with another embodiment of the present invention.

FIG. 2 shows a cross-sectional view of the circulating duct 20 according to one embodiment of the present invention. As shown, preferably, the circulation duct 20 has a plurality of grooves or indentations 20*a* on its inner walls for prolonging a heat exchange time period of the hot and humid air by reducing the flow speed of the water along the inner walls of the circulation duct 20. However, the shape, form or configuration of the inner walls of the circulation duct 20 is not limited to such, but may be of any shape or form that can reduce the water flow speed along the inner walls of the circulation duct 20. For example, as shown in FIG. 3, the circulation duct 20 may have helical grooves 20*b* formed on the inner walls of the circulation duct 20, which reduces a flow speed of the water flowing down from the upper part of the circulation duct 20. This improves a dehumidifying efficiency of the washing machine 100.

Returning to FIG. 1, in addition to or in lieu of the operation of the water supplying duct 40, the washing machine 100 includes an external air supplying duct 30 connected to the case 1 for supplying the external air to the inside of the washing machine. It is also preferable that an external air fan 32 is fitted to an inlet of the external air supplying duct 30 for generating a suction force to draw the external air and directing it to the inside of the circulation duct 20. The external air fan 32 is preferably of an axial type, but can be of any other type known in the art. The external air supplying duct 30 supplies external air to the circulation duct 20 and thereby dehumidifies the air circulating in the circulation duct 20 since the air from the external air supplying duct 30 has a temperature lower than the temperature of the air circulating in the circulation duct 20. That is, the air supplied to the circulation duct 20 through the external air supplying duct 30 makes heat exchange with the air circulating in the circulation duct 20 to condense the moisture in that air.

Although the foregoing embodiment shows a fore end portion of the external air supplying duct 30 (an outlet of the external air) is inserted into the circulation duct 20, the present invention is not limited to such and it is possible to position the fore end portion of the external air supplying duct 30 outside of the circulation duct 20 to cool down an outer surface of the circulation duct 20 and thereby condense the moisture in the air circulating inside the circulation duct 20.

Thus, in this embodiment, the moisture in the air circulating in the circulation duct 20 is removed or reduced by the water supplied through the water supplying duct 40 and the external air supplied through the external air supplying duct 30. However, the present invention is not limited to such, and the dehumidifying function can be carried out by using only one of the water supplying duct 40 and the external air supply duct 30.

The operation of the pulsator type washing machine 100 in accordance with a first preferred embodiment of the present invention will be explained with reference to FIG. 1. At first, the washing machine 100 performs a washing operation. The washing operation of the pulsator type washing machine 100 is the same as or substantially the same as the operation of a related art washing machine. For instance, a washing cycle, a rinsing cycle, and a spinning cycle are carried out sequentially to wash the laundry according to the washing operation.

Upon completion of the spinning cycle of the washing operation, the drying process of the present invention starts. In the drying process, external air is introduced into the circulation duct 20 through the external air supplying duct 30 by the operation of the external air fan 32. The air within the inner tub 5 is also supplied to the circulation duct 20 through the opening 5*a* and the inlet/outlet 20*d* of the circulation duct 20. The combined air in the circulation duct 20 flows upwardly by the operation of the fan 22, and is heated by the heater 15 and supplied to the inside of the inner tub 5. The heated air supplied to the inner tub 5 makes heat exchange with the washed laundry to dry the washed laundry, which in turn generates a humid air with high moisture content. This humid air is then introduced back into the circulation duct 20 through the openings 5*a* and the inlet/outlet 20*d* of the circulation duct 20, and flows upwardly while making heat exchanges with the water supplied from the water supplying duct 40 which removes moisture from the humid air. The moisture removed from the humid air in the circulation duct 20, i.e., the condensed water, is drained out of the washing machine 100 through a lower part of the circulation duct 20, the outer tub 3 and the drain duct 11, or through other means.

Meanwhile, the dry air having a relatively low temperature and humidity is heated by the heater 15 again and supplied to the inner tub 5. This process is repeated for a certain period of time to dry the wet laundry in the inner tub 5. The wet laundry in the inner tub 5 is dried as the heated dry air circulates in the inner tub 5. The drying process of the present invention is completed after a preset circulating period elapses.

A pulsator type washing machine 200 in accordance with a second preferred embodiment of the present invention will be explained with reference to FIGS. 4 and 5.

The basic system and operation of the washing machine 200 is the same as that of the washing machine 100 of the first embodiment, except that (1) the dehumidifying water is supplied, not only to the circulation duct 20, but also to the outer tub 3 to render the dehumidifying operation smoother, (2) the fore end of the external air supplying duct 30 is not inserted into the circulation duct 20, but is exposed to the outside of the circulation duct 20, and (3) the circulation duct 20 is provided with a plurality of cooling fins 24. Explanations of the parts of the second embodiment system identical to the first embodiment will be omitted.

In accordance with the second embodiment, the washing machine 200 includes an external air supplying duct 30' disposed on a rear surface of the case 1 for supplying air in a direction of the circulation duct 20, and an external air fan 32' fitted to or near an inlet of the external air supplying duct 30' for generating a suction force to draw an external air into the external air supplying duct 30'. Because of the location of the duct 30', the external air is discharged from the external air supplying duct 30' onto an outer surface of the circulation duct 20 and an outer surface of the outer tub 3 to make appropriate heat exchanges to provide dry air into the inner tub 5. In addition, a plurality of cooling fins 24 are disposed around the outer surface of the circulation duct 20 to further cool the circulating duct 20.

The washing machine 200 also includes a water supplying duct 40 and a supplementary water supplying duct 42 disposed between the feed water valve 10 and an outer tub cover 50 for supplying water. The water supplying duct 40 and the supplementary water supplying duct 42 are used during the drying process to more efficiently remove moisture from the humid air, thereby improving the drying performance of the washing machine 200.

Figure 4:
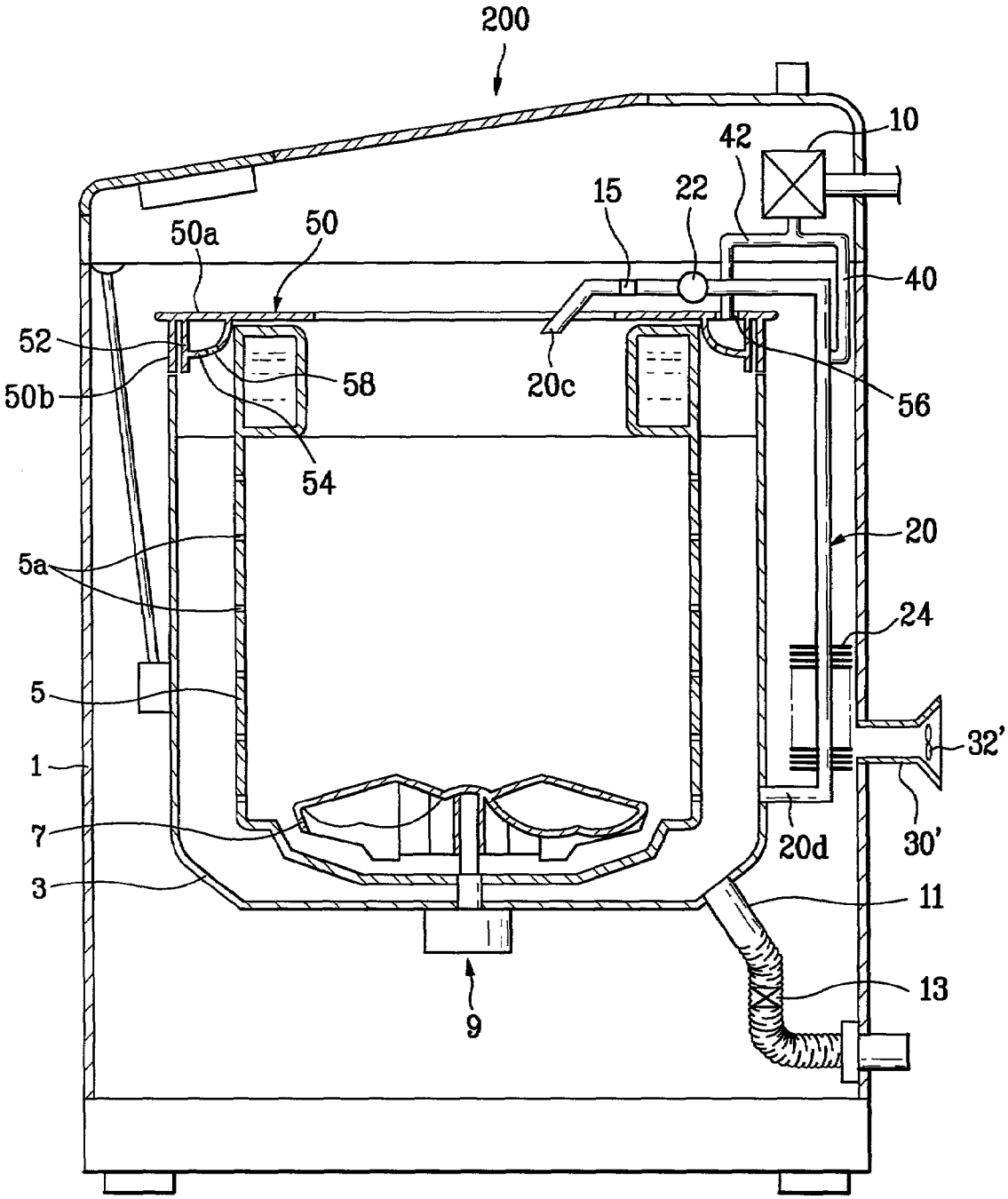
FIG. 4 illustrates a sectional view of a pulsator type washing machine in accordance with a second preferred embodiment of the present invention.
Figure 5:
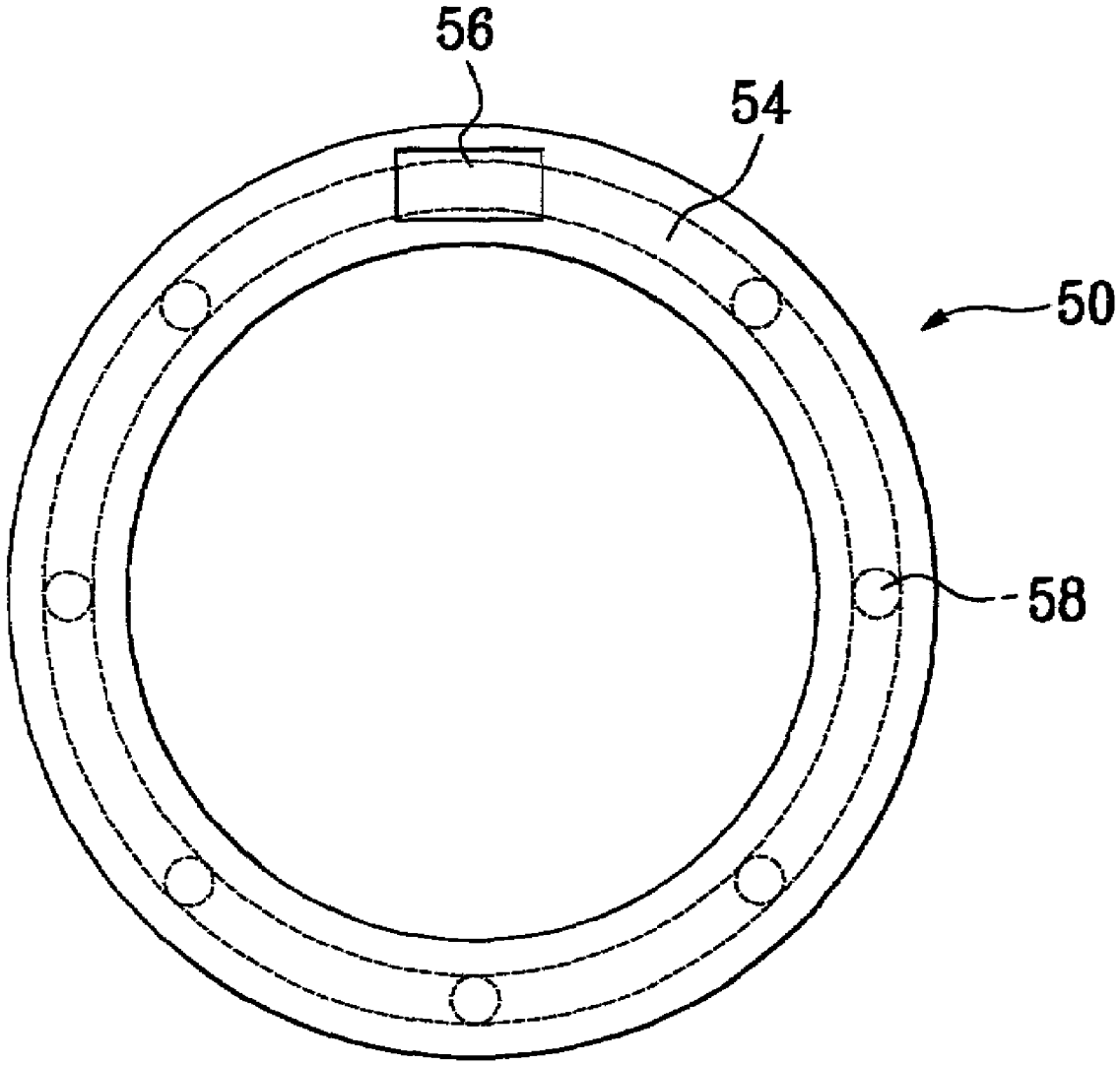
FIG. 5 illustrates a plan view of an outer tub cover of the washing machine in FIG. 4 according to one embodiment of the present invention.

FIG. 5 shows a top plan view of the outer tub cover 50 of FIG. 4 according to one embodiment of the present invention. The structure of the outer tub cover 50 placed on the outer tub 5 will be explained with reference to FIGS. 4 and 5. The outer tub cover 50 includes a horizontal part 50*a* and a vertical part 50*b*. The horizontal part 50*a* has one water supply hole 56 connected to one end of the supplementary water supplying duct 42 for receiving water from the supplementary duct 42. The outer tub cover 50 has a flow passage 54 for flowing the water supplied through the water supply hole 56 around the outer circumference of the inner tub 5. The flow passage 54 has a plurality of water spray holes 58 at fixed intervals for spraying the water in the passage 54 onto the inner walls of the outer tub 3 during the drying process. Accordingly, the outer tub cover 50 corresponding to the outer circumferential shape of the inner tub 5 and the shape of the outer tub 3 and is used to supply external water to the inner walls of the outer tub 3 to dehumidify the air in the outer tub, which will be used to dry the wet laundry. The invention, however, is not limited to the shape and configuration of the outer tub cover 50 as shown in FIG. 5, and includes other shapes and configurations suitable for use with other types of inner and outer tubs.

Figure 6:
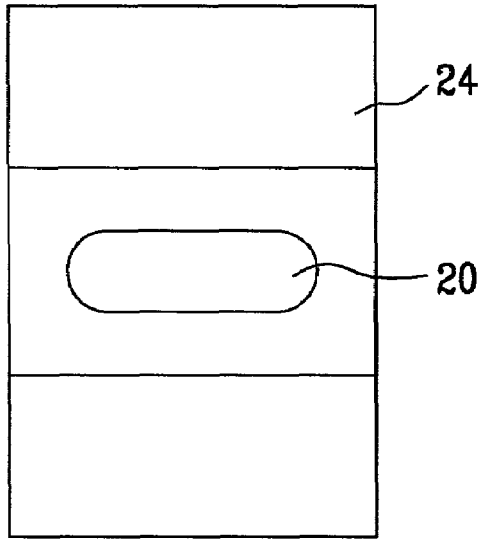
FIG. 6 illustrates a plan view of cooling fins in FIG. 4 coupled with a circulation duct in accordance with one embodiment of the present invention.
Figure 7:
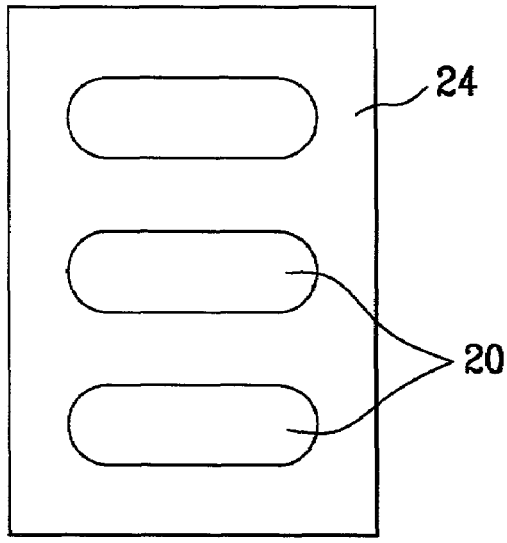
FIG. 7 illustrates a plan view of cooling fins in FIG. 4 coupled with a circulation duct in accordance with another embodiment of the present invention.

FIGS. 6 and 7 show different examples of cooling fins 24 and circulation ducts 20 of FIG. 4. In one embodiment, as shown in FIG. 6, a plurality of cooling fins 24 are disposed on an outer surface of one circulation duct 20 for enhancing a heat transfer efficiency. This improves a dehumidifying efficiency of the washing machine 200. The circulation duct 20 has preferably an oval section, but is not limited to such and can have any other shape and/or configuration. In another embodiment, as shown in FIG. 7, a plurality of circulation ducts 20 are provided in the washing machine 200 and pass through one cooling fin 24 for reducing the length of the circulation duct portion having the dehumidifying function. This results in a more compact circulation duct.

The operation of the pulsator type washing machine 200 is essentially the same as that of the pulsator type washing machine 100, except that the external water is supplied to both the upper part of the circulation duct 20 and the outer tub 3 at the same or substantially same time. Particularly, external water is supplied to the circulation duct 20 via the water supplying duct 40 as discussed above. Also, the external water is supplied to the outer tub cover 50 through the supplementary water supplying duct 42, and is then sprayed onto the inner walls of the outer tub 3 through the water spray holes 58, to make heat exchanges with the air in the outer tub 3 which is recirculated into the inner tub through the circulation duct 20. This removes moisture from the humid air in the outer tub 3. The water removed from the outer tub 3 by the dehumidifying action, i.e., the condensed water, is drained out of the washing machine 200 through the drain duct 11 under control of the duct valve 13 or through some other means. The operation of the outer tub cover 50 improves a dehumidifying efficiency of the washing machine 200.

In addition, external air with a relatively low temperature is supplied to the washing machine 200 through the external air supplying duct 30' by the operation of the fan 32'. The supplied external air causes heat exchanges with the humid air in the circulation duct 20 as the external air passes through the cooling fins 24 on the circulation duct 20 to remove moisture from the humid air flowing inside of the circulation duct 20. The air circulating in the circulation duct 20 is further dehumidified by the operation of the fan 22 and the heater 15, and thus, a very dry air is output to the inside of the inner tub 5 through an outlet 20*c* of the circulation duct 20.

Although the present invention has been described in connection with pulsator type washing machines, it is not limited to such, but is equally applicable to other types of washing machines such as agitator type washing machines. Further, the drying operation of the present invention need not be performed upon the completion of the washing operation, but can be performed at any time drying of laundry or the like is desired. In addition, a washing machine of the present invention can provide only one of many dehumidifying operations offered by the components such as the water supplying duct 40, the air supplying duct 30 or 30', the heater 15, the outer tub cover 50, and the cooling fins 24, as discussed above.

The pulsator type washing machine according to the different embodiments of the present invention has many advantages including the following. First, the in situ drying of the laundry in the inner tub after washing improves user convenience. Moreover, the pulsator type washing provides an excellent washing efficiency. Second, the circulation of heated air, the efficient removal of moisture from the humid air, and heat exchanges with the wet laundry provides an excellent drying performance for the washing machine. Third, the air-dehumidifying operations both by means of air and water improve significantly the dehumidifying effect, thereby improving greatly a drying efficiency of the washing machine. Fourth, a compact washing machine that is capable of both washing and drying operations in an efficient manner is provided.

It will be apparent to those skilled in the art that various modifications and variations can be made in the pulsator type washing machine of the present invention without departing from the spirit or scope of the invention. Thus, it is intended that the present invention covers the modifications and variations of this invention provided they come within the scope of the appended claims and their equivalents.

What is claimed is:

1. A washing machine comprising:

a first tub;

a second tub disposed in the first tub;

multiple circulation ducts operatively coupled to the first tub to receive air from the second tub, dehumidify the air and recirculate the dehumidified air back into the second tub to dry laundry in the second tub during a drying operation of the washing machine; and a single cooling fin having the circulation ducts pass therethrough to dehumidify air in the circulation ducts, wherein the one circulation duct has a plurality of grooves with helical configurations provided at an inner wall surface thereof for prolonging a heat exchange time period of the hot and humid air by reducing the flow speed of water along inner walls of the circulation duct.

2. The washing machine as claimed in claim 1, further comprising a tub cover for discharging external water to inner walls of the first tub to dehumidify air in the first tub during the drying operation.

3. The washing machine as claimed in claim 2, wherein the tub cover has a flow passage placed on the first tub and arranged around an outer circumference of the second tub, further wherein the flow passage has a plurality of water spraying holes disposed on a bottom portion of the tub cover and arranged at fixed intervals for uniformly spraying the water in the passage onto the inner walls of the first tub.

* * * * *